US010099150B2

(12) United States Patent
Sornik et al.

(10) Patent No.: US 10,099,150 B2
(45) Date of Patent: Oct. 16, 2018

(54) WATER RIDE HAVING A VARIABLE WATER LEVEL

(71) Applicant: MACK RIDES GMBH & CO. KG, Waldkirch (DE)

(72) Inventors: Frank Sornik, Waldkirch (DE); Dennis Gordt, Emmendingen (DE)

(73) Assignee: MACK RIDES GMBH & CO. KG, Waldkirch (DE)

( * ) Notice: Subject to any disclaimer, the term of this patent is extended or adjusted under 35 U.S.C. 154(b) by 0 days.

(21) Appl. No.: 15/110,285

(22) PCT Filed: Mar. 11, 2015

(86) PCT No.: PCT/EP2015/055010
§ 371 (c)(1),
(2) Date: Jul. 7, 2016

(87) PCT Pub. No.: WO2015/135963
PCT Pub. Date: Sep. 17, 2015

(65) Prior Publication Data

US 2016/0325189 A1 Nov. 10, 2016

(30) Foreign Application Priority Data

Mar. 11, 2014 (DE) ..... 10 2014 103 226

(51) Int. Cl.
*A63G 21/18* (2006.01)
*A63G 7/00* (2006.01)
(Continued)

(52) U.S. Cl.
CPC ..... *A63G 21/18* (2013.01); *A63G 7/00* (2013.01); *A63G 21/04* (2013.01)

(58) Field of Classification Search
CPC ..... A63G 21/00; A63G 21/02; A63G 21/18; A63G 31/00; A63G 31/007; A63B 69/0093; A63B 2009/008
(Continued)

(56) References Cited

U.S. PATENT DOCUMENTS 5,613,443 A * 3/1997 Ariga ..... A63G 7/00 104/70
6,475,095 B1 * 11/2002 Henry ..... A63G 3/00 405/79
(Continued)

FOREIGN PATENT DOCUMENTS

CN 202620689 U 12/2012
DE 202012012017 U1 4/2013
(Continued)

OTHER PUBLICATIONS

"The Flying Dutchman"; Coasters and More; Jul. 31, 2014.
(Continued)

*Primary Examiner* — Kien Nguyen
(74) *Attorney, Agent, or Firm* — Nath, Goldberg & Meyer; Jerald L. Meyer; Stanley N. Protigal

(57) ABSTRACT

The invention relates to a water ride (10) having a variable water level and a route (20) on which at least one vehicle (12), provided for accommodating at least one rider, can be moved, the route (20) having at least one fixedly arranged route segment (22) in which the at least one vehicle (12) is guided through water (30). In the region of the route segment (22), means are provided for raising or lowering the water level (32) of the water (30) in such a way that the at least one vehicle (12) can pass through the route segment (22) both at a raised water level (32*a*) and at a lowered water level (32*b*).

11 Claims, 3 Drawing Sheets

Figure 1:
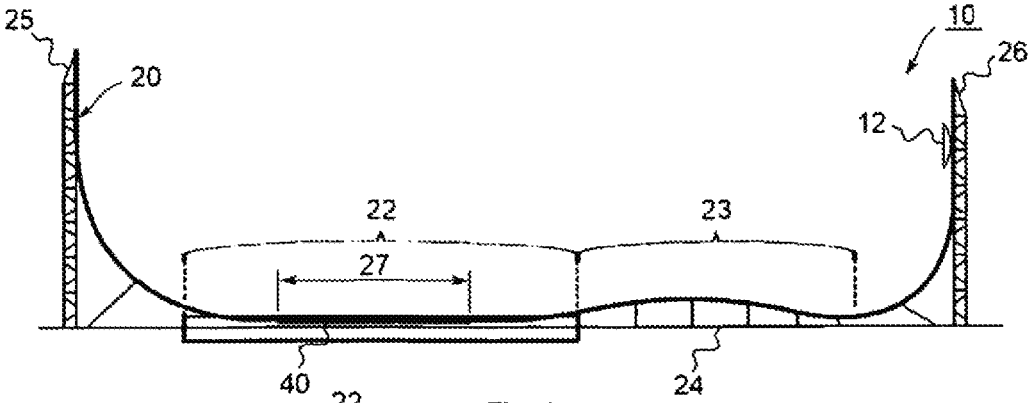

(51) Int. Cl.
*A63G 21/04* (2006.01)
*A63B 69/00* (2006.01)

(58) Field of Classification Search
USPC ..... 472/13, 116, 117, 128, 129; 104/53, 69, 104/70
See application file for complete search history.

(56) References Cited

U.S. PATENT DOCUMENTS

| | | | | |
|---|---|---|---|---|
| 6,758,231 | B1 * | 7/2004 | Lochtefeld | A63G 3/00 104/70 |
| 2013/0244801 | A1 * | 9/2013 | Frolov | A63G 7/00 472/61 |

FOREIGN PATENT DOCUMENTS

| | | | |
|---|---|---|---|
| DE | 102012104687 | B3 | 9/2013 |
| DE | 202012104141 | U1 | 3/2014 |

OTHER PUBLICATIONS

German Office Action dated Jul. 31, 2014 corresponding to application No. 102014103226.8.
Chinese office action dated Jan. 11, 2018 for corresponding CN application 201580013181.4.

* cited by examiner

WATER RIDE HAVING A VARIABLE WATER LEVEL

This is a National Phase Application filed under 35 U.S.C. 371 as a national stage of PCT/EP2015/055010, filed Mar. 11, 2015, an application claiming the benefit of German Application No. 102014103226.8, filed Mar. 11, 2014, the content of each of which is hereby incorporated by reference in its entirety.

This disclosure relates to a water ride having a route along which at least one vehicle can be moved, in which the route has at least one fixedly arranged route segment in which the vehicle is guided through water.

Water rides of this type are well known and are becoming increasingly popular in amusement parks. Such water rides ordinarily include a route with rails along which vehicles can move. At least one stretch of the route is ordinarily configured such that the vehicle is at least partially submerged in the water and passes through the water.

One example of such a water ride is described in DE 298 23 592 U1, from the applicant. The water ride described therein is a spillwater raft ride in which the boats, floating in a water-channeling canal, are equipped with a special undercarriage and with running wheels and guide wheels. In the water-channeling canal the boat floats, and once it leaves the water-channeling canal, the undercarriage including the running wheels and guide wheels guides the boat along a system of rails.

DE 10 2004 062 315 A1, also from the applicant, describes another water ride, in which the watercraft is guided safely even along downhill sections having substantial changes in elevation, and upon entering the water, the floating body of the watercraft executes natural floating movements, even with varying loads. To enable this, the watercraft is equipped with a floating body, which is connected to an undercarriage that serves as a guide unit via a flexible and/or articulated connecting unit. As a result, limited relative movement between the floating body of the watercraft and the undercarriage is permitted.

Finally, DE 198 03 465 C2 describes a system for amusement park boat rides in which passengers can travel in boat-like vehicles over a watercourse from a first launch station at one end of the watercourse to an opposite end along a guide channel, and from there back again. As the drive mechanism, a traction cable is secured to the passenger boat and can be used to pull the passenger boat back and forth on two take-up reels at the end of the watercourse.

Common among all of these known water rides is that the vehicles in the rides travel along a predetermined route segment through a water basin having a predetermined water level, with the water level being fixed.

This is where the present invention comes into play.

The object of the invention is to further enhance a water ride of the aforementioned type such that the riding enjoyment riders experience during the water ride is increased, and such that the watercraft can be readily accelerated in the area of the water-filled route segment without exposing the watercraft to increased water resistance.

This object is achieved by a water ride in which, in the region of the route segment, the water level of the water is raised or lowered such that during a ride, the vehicle can pass through the route segment both at a raised water level and at a lowered water level.

Further enhancements of such a water ride are the subject matter of the dependent claims.

The invention involves primarily providing means by which it is possible to raise and lower the water level along a predetermined route segment of the water ride as rapidly as possible in a simple manner. This enables the watercraft to be moved along the same route segment one time at a raised water level and another time at a lower water level, which may even be zero, along the fixed route.

Suitable means are, for example, water basins having flood doors and a pumping station, provided in the region of said route segment. Initially, the water basins are filled with water, and a suitable control device is used to open the flood doors or sluices to the water basins in order to fill the route segment through which the vehicles are traveling with water up to a predetermined water level. During the ride, the vehicles then travel along this route segment through relatively deep water, resulting, at a corresponding vehicle speed, in the popular bow waves (splash) in front of the vehicle and the plumes of water at the rear of the vehicle as it travels along the route segment.

When the vehicle passes through the same route segment a second time, the water level can then be lowered, optionally even to zero, using the aforementioned means. To accomplish this, the aforementioned flood doors are closed and the water is pumped from the route segment back to the water basins via the pumping station. The vehicles then pass through this route segment with relatively little water or even no water. The resistance acting on the vehicles can thereby be substantially reduced. This is advantageous if acceleration devices such as linear drives, for example, for the vehicles are provided in this route segment.

It is within the scope of the present invention for the aforementioned route segment in which the water level is variable to be part of a closed or open roller coaster. The latter are known as so-called "shuttle coasters". In place of a roller coaster any other route types, such as a back-and-forth coaster, for example a swinging coaster, may also be used.

It has further proven advantageous to position a loading and unloading apparatus for the vehicles in the region of said route segment. A suitable loading and unloading apparatus may be a turntable on which one or more vehicles are arranged. The vehicles are then removed from the turntable and placed on the route segment.

Although the description has thus far focused on the water level in the aforementioned route segment being varied, it is also within the scope of the present invention for the water level in the route segment to remain constant and for the system of rails provided along the route segment on which the vehicles are guided to be raised or lowered. However, this variant is significantly more costly to implement.

Figure 2:
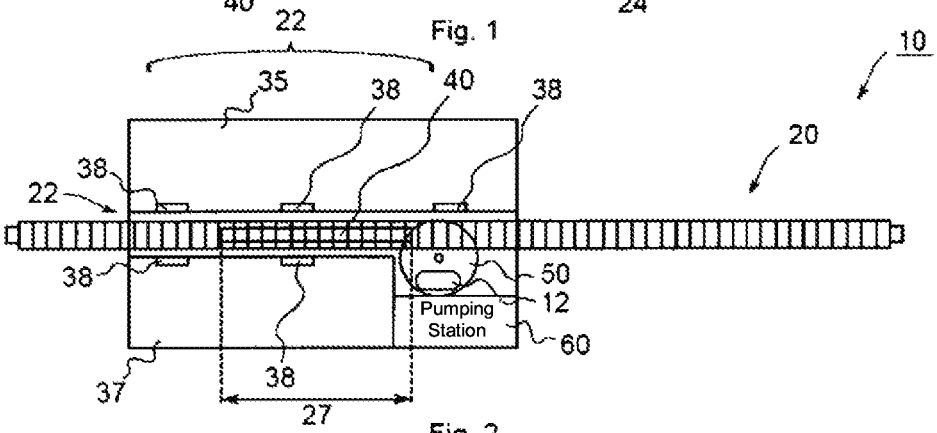
Figure 3:
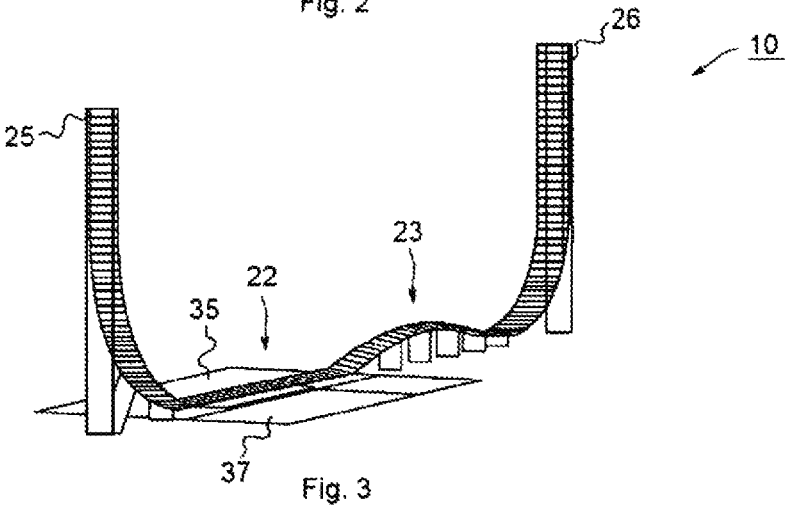
Figure 4:
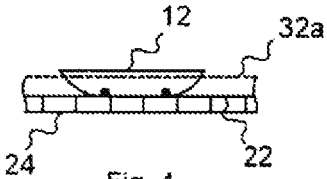
Figure 5:
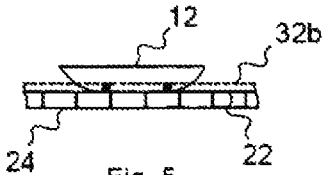
Figure 6:
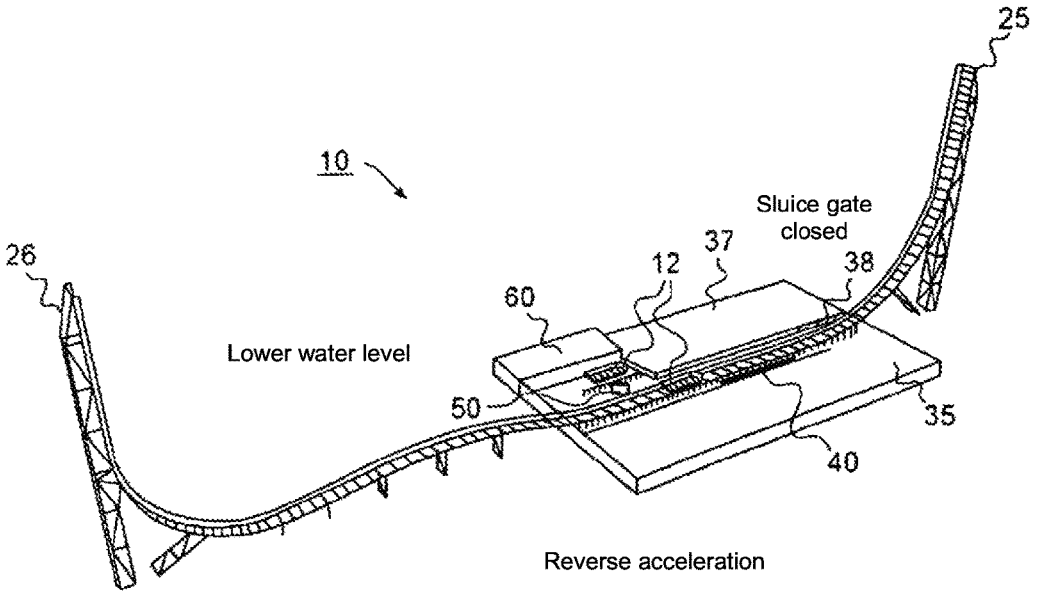
Figure 7:
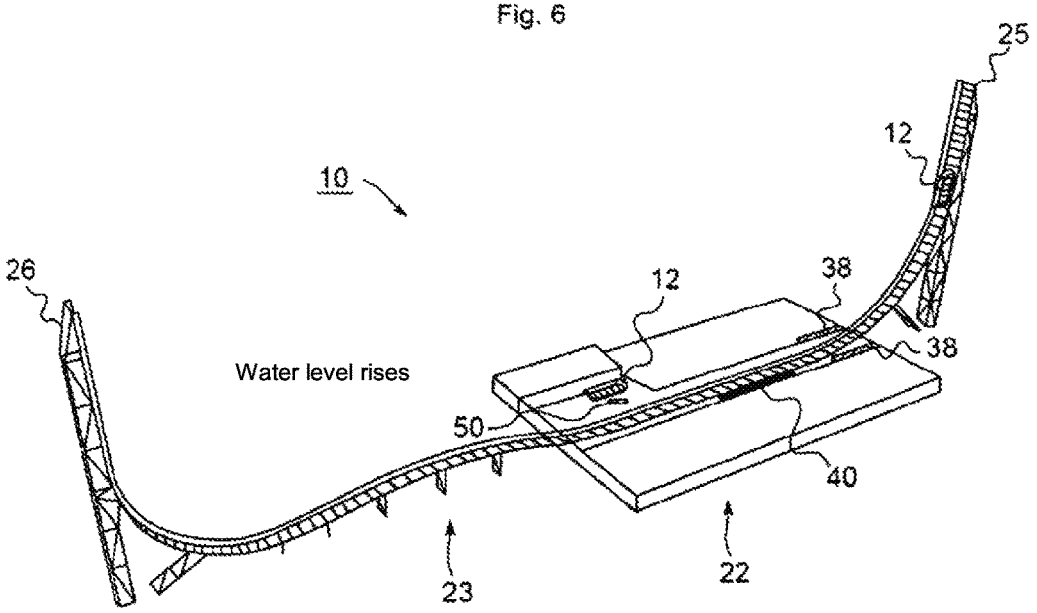
Figure 8:
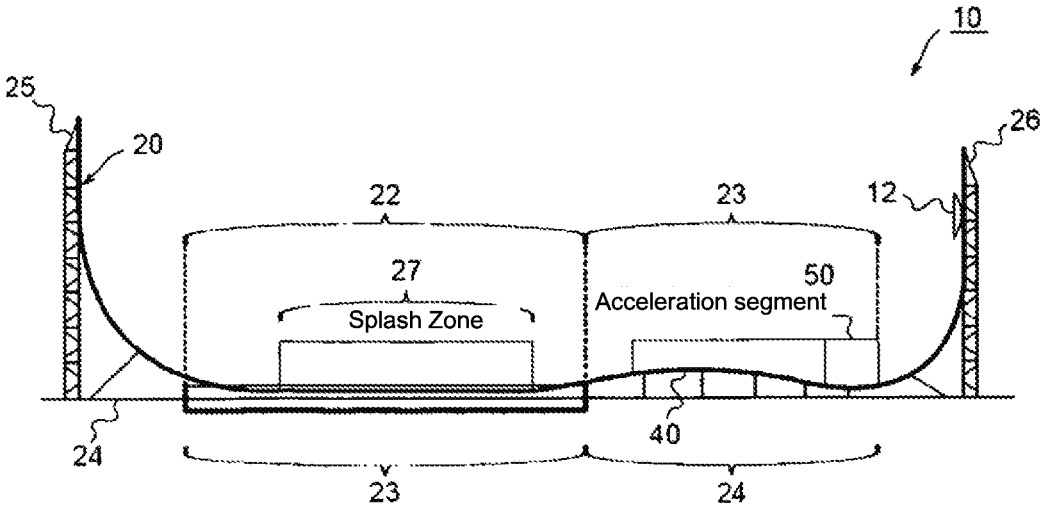
Figure 9:
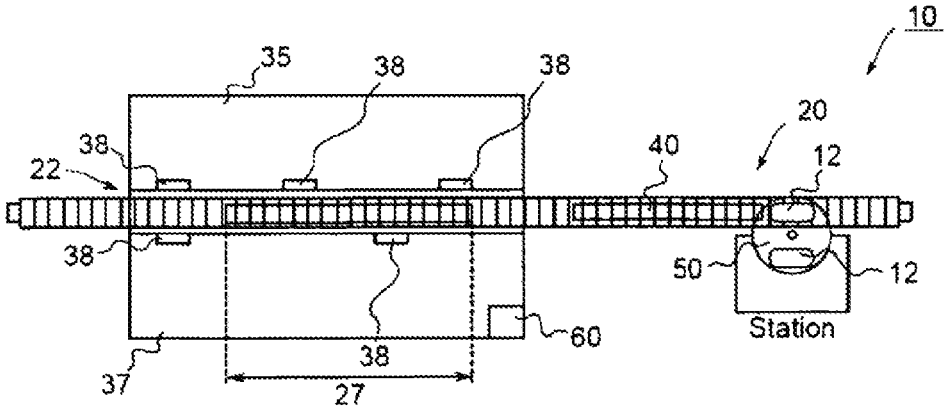

In the following, the water ride according to the present invention will be described in greater detail in the context of two embodiments, with reference to several figures. The drawings show:

FIG. 1 a side view of a first embodiment of the water ride,

FIG. 2 a plan view of the water ride of FIG. 1,

FIG. 3 a perspective view of the water ride as shown in FIG. 1 and FIG. 2, FIG. 4 a schematic diagram of a route segment of the water ride in FIGS. 1 to 3 with a vehicle positioned on the route segment and a relatively high water level, FIG. 5 a view similar to FIG. 4, but with a lowered water level, FIG. 6 a view of the water ride similar to that of FIG. 3 from a perspective view, with an unloading and loading station for loading vehicles onto the route segment at a low water level, FIG. 7 the water ride of FIG. 6 in which the water level along the route segment is high, FIG. 8 a side view of a water ride according to a second embodiment, and FIG. 9 a plan view of the water ride of FIG. 8.

In the following figures, unless otherwise indicated, like reference signs denote like parts with the same meaning.

FIGS. 1 to 3 illustrate the embodiment example of a water ride 10. In the embodiment example, this water ride 10 is equipped with a route 20, which is configured as a track comprising two rails, extending in a straight line. Route 20 is selected such that, as viewed from left to right in FIG. 1, route 20 begins with a vertically descending segment, then transitions into a quarter-circle arc leading into a straight route segment 22. This route segment 22 leads into a further route segment 23, which forms a wave-shaped rise. At the end of this additional route segment 23 is another quarter-circle arc, ending route 20 in a second vertical region. In the vertical regions, a first tower 25 and a second tower 26 are provided for this purpose, on which the two ends of route 20 are secured. The two towers 25, 26 may be spaced more than one hundred meters apart from one another, for example. The height of the towers may be forty meters, for example. In FIG. 1, a vehicle 12 is shown located on tower 26, shown on the right. This vehicle 12 can travel along route 20 by means of a suitable acceleration device.

One or more linear drives may be provided, for example, as the acceleration device. These linear drives, which are known per se, are located in the embodiment example of FIGS. 1 to 3 on route 20 in the region of route segment 22 and are denoted by reference sign 40. The described drives may also be located in any other region along the route.

To enable the vehicles 12 to be accelerated with such linear drives 40, the vehicles 12 are in turn provided with suitable drive components, such as permanent magnets, for example.

As shown in FIG. 2, a loading and unloading station 50 for conveying a vehicle 12 onto the rail or up to the rail is located in route segment 22, immediately adjacent to route 20, i.e. adjacent to the tracks. Loading and unloading station 50 may be a turntable, for example. Once vehicle 12 has been placed on route segment 22, vehicle 12 can be accelerated toward the left or toward the right by activating linear drives 40. The acceleration may also be varied such that the vehicle reaches the upper end of route 20 on tower 26, for example, where it may be held in place by suitable braking means or may immediately reverse its direction of travel, autonomously due to the force of gravity, or even with acceleration by means of suitable drives. Once the braking means have been released, for example, vehicle 12 accelerates downward along route 20, reaching route segment 23 first, followed by subsequent route segment 22. There, vehicle 12 can be further accelerated by means of linear drive 40, causing the vehicle to travel along route 20 until it reaches the upper end of the route on tower 25. There, vehicle 12 can again be held in place or released immediately for a return trip.

Particular riding enjoyment results from the fact that route segment 22 can be filled with water, and the water level therein can be varied. For this purpose, water ride 10 is equipped with two water basins 35, 37, for example, located immediately adjacent to route segment 22, which are filled with water. Water basins 35, 37 are equipped with sluice gates 38. Once these gates are opened via a control device, not shown in FIG. 2, the water floods the tracks in route segment 22 to a greater or lesser extent, depending on when sluice gates 38 are closed again. It is understood that route 20, in the region of route segment 22, to the left and right of which the two water basins 35 37 are located, is configured such that the water cannot flow out at the entrances to and exits from said route segment, ensuring that only route segment 22 is flooded. Care must therefore be taken to ensure that the water coming from basins 35, 37 is prevented from flowing uncontrolled out of route segment 22. This is self-evident, however.

In FIG. 4, a water level 32*a* is shown which is relatively high, nearly reaching the upper edge of watercraft 12. A pumping station 60, indicated in FIG. 2, can be used to lower this high water level 32*a* by pumping the water out of route segment 22, for example to a level as indicated in FIG. 5 by reference sign 32*b*. Water level 32*b* is so low that only the wheels of vehicles 12 remain below water. However, pumping station 60 may also be used to lower water level 32*b* to zero, so that not only the rails of route segment 22 but even base 24 is visible.

At such a low water level, as indicated in FIG. 5 by reference sign 32*b* or at an even lower water level, vehicles 12 can be easily driven via linear drives 40 without having to overcome substantial water resistance.

The method for operating water ride 10 will be detailed in reference to FIGS. 6 and 7.

It is assumed that in FIG. 6, the water is at a low level, for example as indicated in FIG. 5 by reference sign 32*b*. On a turntable 50, two vehicles 12 are located, offset 180° relative to one another. One of vehicles 12 has just been placed on route segment 22. By means of linear drive 40, this vehicle 12 is then accelerated along route 20, up to approximately one-half the height of tower 26. At one-half the height of tower 25, gravity forces vehicle 12 to reverse its direction of travel and earth's gravitational pull accelerates the vehicle, returning it to route segment 22, where a relatively low water level 32*b* is present. Linear drive 40 again accelerates the vehicle in route segment 22, but this time in the opposite direction, so that vehicle 12 travels at increased speed over the slight rise in route segment 23 and nearly reaches the upper end of tower 26. There, gravity again forces the vehicle to reverse its direction of travel and return via route segment 23, nearly reaching the upper end of tower 25; once the vehicle leaves route segment 22, sluice gates 38 are opened, allowing water from water basins 35, 37 to flood route segment 22 at high speed, thereby raising the water level to the height indicated in FIG. 4 (see reference sign 32*a*). At the highest point on tower 25, vehicle 12 then reverses direction to then travel at high speed through the flooded route segment 22, generating the desired large bow wave (splash) with plumes of water trailing behind the vehicle. The area of the route along which this large bow wave (splash) is generated in route 20 is denoted in FIGS. 1 and 2 by reference sign 27.

When vehicle 12 has traveled once again onto tower 26 and has reversed its direction due to gravity, it finally returns to the region of route segment 22, where linear drives 40 now decelerate and stop of vehicle 12. Vehicle 12 is then received by turntable 50. Turntable 50 rotates to place the second vehicle 12, which in the meantime has been filled with riders, onto the rail system of route 20 in a similar manner. The process may be varied in terms of the number of passes.

FIGS. 8 and 9 show a second embodiment of a water ride having a variable water level. FIG. 8 shows water ride 10 from a side view, similar to that of FIG. 1, and FIG. 9 shows a plan view of said water ride 10. In contrast to the first embodiment example of FIGS. 1 to 7, here the linear drives 40 are located not in the region between the water basins 35, 37, that is to say, not in route segment 22, but in route segment 23, located to the right side thereof. Likewise, loading and unloading station 50 is located not in the region between the two water basins 35, 37, but between the region of linear drives 40 and right tower 26. Loading and unloading station 50 is again embodied as a turntable, which in the present case can be used to place two vehicles 12 alternatingly on route 20. It is of course also within the scope of the invention for the entire ride to be operated with only a single vehicle 12. In that case, the loading and unloading station 50 may be dispensed with.

Although only a ride embodied as a back-and-forth coaster has been described in connection with the embodiment examples, it is also within the scope of the present invention for only one route segment of a circular coaster, in particular a roller coaster, to be equipped with a back-and-forth travel capability. In that case, during travel in one direction, no water or only a small amount of water is located in a region along the route and during travel in the reverse direction, significantly more water is located in this region, in order to achieve the desired "splash".

It is further within the scope of the invention to provide another type of guidance system for the vehicles in place of a rail-based guidance system, for example magnetic strips, a cable guidance system, or the like. It is also possible for the vehicles to be guided similarly to a bobsled track, in which the vehicles are guided within a trough-shaped route.

LIST OF REFERENCE SIGNS

10 water ride
12 vehicle
20 route
22 route segment
23 route segment
24 base
25 first tower
26 second tower
27 splash zone
30 water
32 water level
32*a* high water level
32*b* low water level
35 water basin
37 water basin
38 sluice gate
40 linear drive
50 loading and unloading station
60 pumping station

The invention claimed is:

1. A water ride (10) having a route (20), configured as a railed track, along which at least one vehicle (12) provided for accommodating at least one rider can be moved, the route (20) having at least one fixedly arranged route segment (22) in which the at least one vehicle (12) is guided through water (30), characterized in that in a region of the route segment (22), means are provided for raising or lowering the water level (32) of the water (30) such that during a ride, the at least one vehicle (12) can pass through the route segment (22) both at a raised water level (32*a*) and at a lowered water level (32*b*);

and further characterized in that the at least one vehicle (12) can be driven by means of one or more drives (40).

2. The water ride (10) according to claim 1, characterized in that the lowered water level (32*b*) is a water level (32) between the raised water level (32*a*) and zero or nearly zero.

3. The water ride (10) according to claim 2, characterized in that the means comprise at least one device for raising and lowering the water level (60) and a water basin (35, 37), by means of which the water (30) can be removed from the route segment (22), and a flood device or pump (38), by means of which the water (30) can be moved out of the water basin (35, 37) into the route segment (22).

4. The water ride (10) according to claim 1, characterized in that the at least one vehicle (12) can be driven by means of one or more linear drive (40).

5. The water ride (10) according to claim 4, characterized in that the one or more linear drive (40) is positioned along the route.

6. The water ride (10) according to claim 1, characterized in that the route segment (22) extends in a straight line and preferably has a height profile.

7. The water ride (10) according to claim 1, characterized in that the route segment (22) is part of a roller coaster.

8. The water ride (10) according to claim 1, characterized in that the route segment (22) is part of a back-and-forth coaster.

9. The water ride (10) according to claim 1, characterized in that the at least one vehicle (12) can be moved onto the route (20) in the region of the route segment (22) by means of a loading and unloading station (50).

10. The water ride (10) according to claim 1, characterized in that the route (20) is a rail, on or along which the at least one vehicle (12) can be moved.

11. A method for operating a water ride (10), the water ride (10) having a route (20), configured as a railed track, along which at least one vehicle (12) provided for accommodating at least one rider can be moved, the route (20) having at least one fixedly arranged route segment (22) in which the at least one vehicle (12) is guided through water (30), characterized in that in the region of the route segment (22), means are provided for raising or lowering the water level (32) of the water (30), the method comprising the following steps:

accelerating the vehicle by means of a drive when the water level (32) in the route segment (22) is lowered, and travelling the vehicle through the route segment when the water level (32) is raised, thereby generating a splash.

* * * * *